US012434124B2

(12) United States Patent
Farnham et al.

(10) Patent No.: US 12,434,124 B2
(45) Date of Patent: Oct. 7, 2025

(54) TRAINING DEVICE TO DELIVER SPORTS BALLS FOR PRACTICE

(71) Applicants: Taylor A Farnham, Ojai, CA (US); Andrew L. Prestridge, Ojai, CA (US); Jong H. Yang, Santa Barbara, CA (US); Pierrette Pelham Prestridge, Ojai, CA (US)

(72) Inventors: Taylor A Farnham, Ojai, CA (US); Andrew L. Prestridge, Ojai, CA (US); Jong H. Yang, Santa Barbara, CA (US); Pierrette Pelham Prestridge, Ojai, CA (US)

( * ) Notice: Subject to any disclaimer, the term of this patent is extended or adjusted under 35 U.S.C. 154(b) by 215 days.

(21) Appl. No.: 18/196,105

(22) Filed: May 11, 2023

(65) Prior Publication Data

US 2024/0374980 A1 Nov. 14, 2024

(51) Int. Cl.
*A63B 69/40* (2006.01)
*A63B 47/00* (2006.01)

(52) U.S. Cl.
CPC ..... *A63B 69/407* (2013.01); *A63B 47/002* (2013.01); *A63B 2210/50* (2013.01)

(58) Field of Classification Search
CPC ..... A63B 69/40; A63B 69/406; A63B 69/407; A63B 69/408; A63B 69/409; A63B 69/00; A63B 69/0002; A63B 69/0015; A63B 69/0017; A63B 69/002; A63B 69/0024; A63B 69/0026; A63B 69/0071; A63B 69/0095; A63B 2069/0004; A63B 2069/0006; A63B 2069/0008; A63B 2069/0011; A63B 2069/401; A63B 2069/402; A63B 2069/403; A63B 2069/404; A63B 2069/405; A63B 47/002; A01K 15/025; F41B 3/03; F41B 11/50; F41B 11/52
USPC ..... 124/6, 7, 8, 78, 45, 47
See application file for complete search history.

(56) References Cited

U.S. PATENT DOCUMENTS 3,815,567 A * 6/1974 Serra ..... A63B 69/406 124/78
4,027,646 A * 6/1977 Sweeton ..... A63B 69/409 124/56
RE29,479 E * 11/1977 Mohr ..... A63B 69/40 124/1

(Continued)

FOREIGN PATENT DOCUMENTS

CN 110787435 * 2/2020 ..... A63B 69/40

*Primary Examiner* — John E Simms, Jr.

(57) ABSTRACT

A device capable of repeatedly delivering one or more sports balls to the user in a time-controlled manner that mimics a human toss, without the use of electronic controls or electronic regulators. The device may be customizable to fit the needs or preferences of the user, such as being collapsible, foldable, expandable, or otherwise able to increase or decrease its enclosed volume or capacity. Similarly, the height, angle, and elevation of the present invention may be adjustable through members that may also be collapsible, foldable, telescoping, or otherwise adjusted. Embodiments of the device include time control elements to restrict the delivery of the sports balls that utilize friction, air resistance, fluid resistance, magnetism, Eddy current braking, resonance, vibration, or any combination therein to influence the time control.

7 Claims, 2 Drawing Sheets

(56) References Cited

U.S. PATENT DOCUMENTS 4,091,791 A * 5/1978 Castelli ..... F41B 11/52 124/81
4,092,823 A * 6/1978 Shiro ..... G04B 19/04 968/142
4,210,324 A * 7/1980 Morrison ..... A63F 9/00 273/440
4,300,479 A * 11/1981 Demko ..... A01K 31/07 119/427
4,834,060 A * 5/1989 Greene ..... A63B 69/406 124/78
5,097,985 A * 3/1992 Jones ..... A63B 47/002 221/277
5,107,820 A * 4/1992 Salansky ..... A63B 69/40 124/78
6,176,230 B1 * 1/2001 Thompson ..... A01K 15/025 124/16
6,190,271 B1 * 2/2001 Rappaport ..... A63B 69/0002 124/78
6,672,969 B2 * 1/2004 Lee ..... A63B 57/0006 473/134
6,843,241 B1 * 1/2005 Newcomer ..... A63B 69/407 124/16
8,123,634 B1 * 2/2012 Lovett ..... A63B 47/02 473/436
8,151,782 B2 4/2012 Huang
9,186,566 B2 11/2015 Boehner
11,077,352 B1 * 8/2021 Greene, Jr. ..... A63B 69/406
11,937,574 B2 * 3/2024 Chang ..... B25J 9/0003
2004/0087390 A1 * 5/2004 Mauer ..... A63B 69/40 473/422
2006/0213453 A1 * 9/2006 Conrady ..... A01K 15/025 119/707
2015/0328524 A1 * 11/2015 Backowski ..... A63B 69/40 124/59
2016/0227741 A1 * 8/2016 Hsu ..... A01K 15/027
2020/0398139 A1 * 12/2020 Harley ..... A63B 69/406
2023/0201690 A1 * 6/2023 Galiano ..... A63B 69/406 124/78

* cited by examiner

TRAINING DEVICE TO DELIVER SPORTS BALLS FOR PRACTICE

CROSS-REFERENCE TO RELATED APPLICATIONS

This application claims priority and benefit of the U.S. Provisional Patent Application No. 63/341,204 entitled "Training device to deliver sports balls for practice," filed May 12, 2022, the entirety of which is incorporated herein by reference.

BACKGROUND OF THE INVENTION

The present invention relates to a mechanical device capable of time-regulated delivery of one or more sports balls, including but not limited to: tennis balls, footballs, Rugby balls, hockey pucks, baseballs, cricket balls, handballs, shuttlecocks, lacrosse balls, softballs, pickleballs, wiffle balls, and ping pong balls, and the like, to a user in a manner consistent with a drop or soft toss for the purpose including, but not limited to: practicing the hitting of the sports ball to improve skill, timing, technique and other elements required by the sport, or as otherwise desired by the user. The present invention may be customizable to fit the needs or preferences of the user, such as being collapsible, foldable, expandable, or otherwise able to increase or decrease its enclosed volume or capacity. Similarly, the height, angle, and elevation of the present invention may be adjustable through members that may also be collapsible, foldable, telescoping, or otherwise adjusted.

The current state of the art relies on electronic means for either ball delivery, ball timing, and/or ball control. Existing devices may include a reservoir of balls and then use an electric motor to control the timing to advance the balls toward a dispensing mechanism. The balls may then be released, propelled forward, or accelerated, through a variety of sub-systems, often spinning flywheels or a pneumatic discharge. However, preparing for a subsequent ball release is accomplished through electronic means, most commonly using an electric motor to advance the subsequent ball into position, or to move/remove a restriction allowing the subsequent ball to advance through the device's delivery routine. The improvement consisting essentially of a mechanical energy storage system, a mechanical activation system, mechanical ball control and release mechanism, and mechanical time-control element eliminate the need for any electronic system, battery, or electrical power source.

U.S. Pat. No. 9,186,566 teaches a device that pitches balls, primarily footballs, through the use of motor-powered wheels. The device requires the ball be directly fed in, by another non-practicing participant. As the participant feeds balls into the device, they are propelled toward one or more users who can catch, receive, or otherwise continue their practice as if the ball had been pitched or snapped. However, the device is unable to run autonomously, or without being actively fed by a participant.

By contrast, U.S. Pat. No. 6,843,241 teaches a device that eliminates the non-practicing participant and mimics a soft toss as it pitches a ball to a hitter. The device uses a ball firing assembly and release assembly to allow the user to trigger the release of the ball. Similarly, U.S. Pat. No. 6,672,969 teaches a device that replaces golf balls onto a tee from a hopper. While the assemblies may be mechanical in nature, they rely on the direct and immediate action of the user. Whether through a trigger or an explicit action (such as hitting the golf ball) the devices react in direct response to the user, eliminating the element of unpredictability that lays inherent in sports and sport practice. A hitter can rarely control the precise timing of when a ball is pitched toward them, and never to the extent afforded by a direct trigger mechanism. The slight unpredictability, present in motorized control and especially present in mechanical control, enhances the training routine by honing the reaction of the user. In essence, by removing the non-practicing participant, the devices have removed the element of unpredictability.

U.S. Pat. No. 5,097,985 teaches a device that delivers multiple softballs, baseballs, or articles that have been dispensed through the action of a rotating vane. Critically, this vane is powered by an electric motor, and the sole element of time control for the device is through a variable-speed electric motor. While the device may be battery-powered, it is still reliant on electricity, and will eventually need to recharge or be directly connected to an electric source. With no internal mechanical energy storage, the device cannot be recharged directly by the user, and will require an additional external power source for operation.

While U.S. Pat. No. 8,151,782 teaches a device with a spring-shaped elastic member that aids in the delayed release of pitched baseballs, the delay is critically triggered when "the user treads upon the pedal to let one practice ball get into the ball pitching hole." Thus, the spring-shaped elastic member delivers a secondary time control effect, and the device is most proximately triggered through the direct action of the user. As a result, the device cannot run continuously, and requires the continual intervention of the user to continue its operation.

The state of the art shows significant breadth, encompassing options from non-participants feeding balls into device, to user-triggered actions, to external electric motors for continuous operation. However, the option for a continuous mechanical operation has remained elusive. Developing a precise time-controlling mechanical mechanism capable of delivering multiple sports balls without a direct user action and without electronic controls or electronic regulators has remained a problem notwithstanding the advancement in the state of the art.

SUMMARY OF THE INVENTION

The present invention is a device capable of repeatedly delivering one or more sports balls to the user in a time-controlled manner that mimics a human toss, without the use of electronic controls or electronic regulators.

BRIEF DESCRIPTION OF DRAWINGS

The present invention will now be described by way of illustration without limitation, according to a preferred embodiment, with particular reference to the figures of the annexed drawings in which.

DETAILED DESCRIPTION OF THE INVENTION

Figure 4:
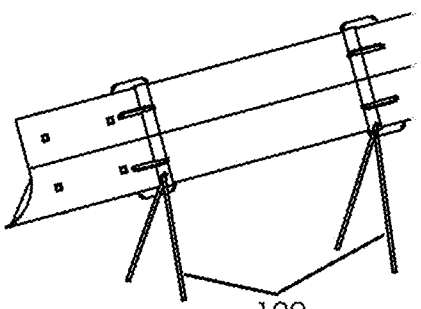
FIG. 4 is an elevation view of an exemplary embodiment of the present invention in which the device is supported by a stand

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

The present invention is a device that enables time-controlled and regulated delivery of "sports balls" in a manner consistent with a drop or soft toss, without the use of electronics or electro-mechanical components. "Sports balls" may consist of, but are not limited to, articles used in the performance of athletic activities, recreation, exercise, practice, that involve direct or indirection action with the user, either individually, or as a team of one or more users. Sports balls may further consist of, but are not limited to, spheres, spheroids, oblate spheroids, generally spherical objects, generally cylindrical objects, objects with one or more rounded faces, and/or cuboids. Examples of sports balls include, but are not limited to: tennis balls, footballs, Rugby balls, hockey pucks, baseballs, cricket balls, handballs, shuttlecocks, lacrosse balls, softballs, pickleballs, wiffle balls, and ping pong balls.

Figure 2:
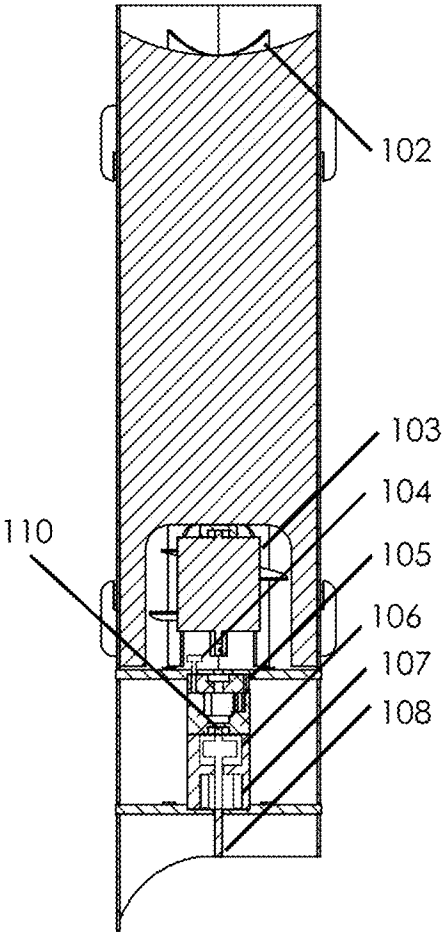
FIG. 2 is a cross-section of the side view of an exemplary embodiment of the present invention in which the ball reservoir is formed through the combination of an outer sleeve and one or more dividers that form multiple cavities within the sleeve
Figure 1:
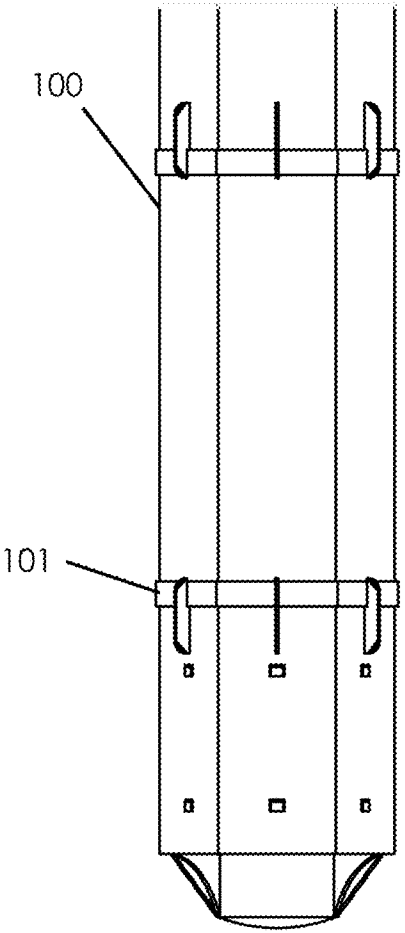
FIG. 1 is a simplified front view of an exemplary embodiment of the present invention in which the ball reservoir is secured by one or more straps

Referring to FIG. 1, a ball reservoir holds one or more balls in preparation for release and supported by an optional strap [101]. Referring to FIG. 2, the ball reservoir is subdivided into multiple channels through the use of one or more dividers [102], a ball portioning control [103] works in concert with the ball time control [105], including a rate limiter [104], to deliver only the prescribed number of balls at the prescribed time interval either directly or through a ball control element.

The ball reservoir consists of one or more tubes or channels that direct the sports balls toward the ball portioning control. In one embodiment, all balls are loaded into a single reservoir tube and are directed toward a linear arrangement (each ball following sequentially from the ball preceding it) through the use of baffles, vanes, protrusions, and/or recesses intended to direct the motion of the balls. Such direction and sorting may occur either at or before interaction with the ball portioning control.

In a second embodiment, the ball reservoir consists of a plurality of tubes or channels, wherein each channel maintains a sequential ordering of the balls. In this embodiment, the ball portioning control may: dispense the prescribed number of balls from one or more tubes while switching between tubes sequentially, at random, or as prescribed; dispense the prescribed number of balls from a subset of tubes, including a singular tube, until those tubes are exhausted and move on to the next tube sequentially, at random, or as prescribed; or through other prescribed orderings or sequences. Such channels may be, but are not required to be, formed by using dividers to divide one enclosed region into multiple enclosed regions.

In either embodiment the ball reservoir may be detached and reattached from the remainder of the device. The attachment and detachment may be accomplished through features including, but not limited to, clasps, hooks, adhesives, flexures, magnets, cords, ropes, and the like. While detached, the reservoir may, but is not required to, retain the loaded balls such that balls may only dispense from the reservoir once the reservoir is reattached to the remainder of the device.

In either embodiment the ball reservoir may include one or more folding, hinged, collapsible, and/or flexible, elements such that the volume enclosed by the ball reservoir may increase or decrease. Such elements may further include flexures, stretch, compression, or other deformation to effect change in the enclosed volume of the ball reservoir. Such elements may further modify the capacity of the device to hold, and/or deliver sports balls without affecting the enclosed volume of the ball reservoir by means of enabling/disabling, mobilizing/immobilizing, activating/deactivating, individual sports balls or subsets of the sports balls within the ball reservoir, such as those in tubes, channels, or otherwise divided.

Figure 5:
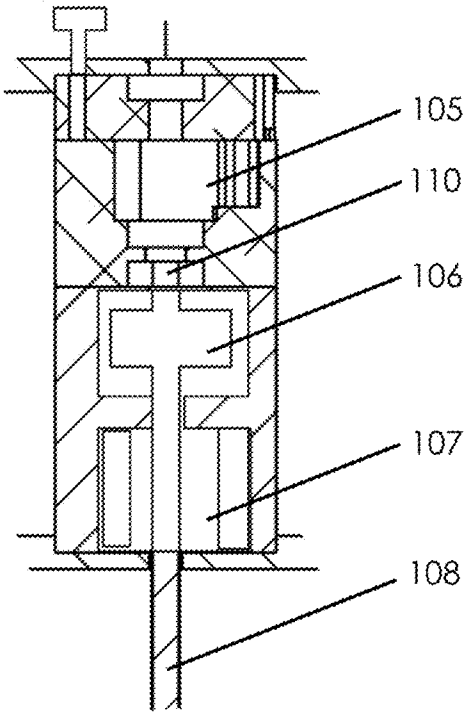
FIG. 5 is an expanded view of the lower portion of the exemplary embodiment shown in FIG. 2.

Referring to FIG. 2 and FIG. 5, the ball time control is comprised of: a first shaft to receive mechanical input from a user [108], a spring motor to store mechanical energy

Figure 7:
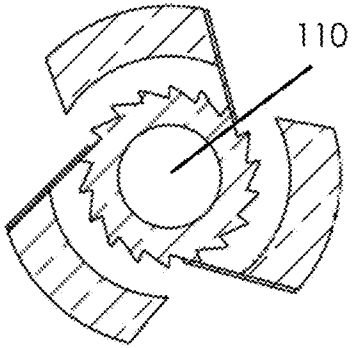
FIG. 7 is a simplified cross-section of an illustrative freewheel, where the central shaft is free to rotate clockwise, but engages its outer housing when rotating counter-clockwise
Figure 6:
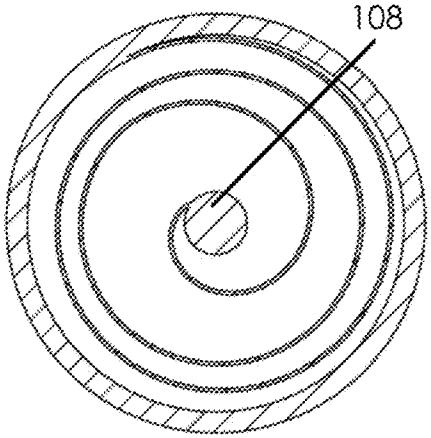
FIG. 6 is a simplified cross-section of an illustrative spring motor, where the central shaft is coupled to the outer housing through a rotational spring

[107], a freewheel to restrict the direction and output of the stored energy [106] and a second shaft [110] with rate limiter to limit the rate, time, and/or the duration over which the stored energy is released [105]. An illustrative cross-section of a spring motor is shown in FIG. 6 and an illustrative cross-section of a freewheel is shown in FIG. 7. In one embodiment, the user applies a rotation to a spring, storing the potential energy within the deflection and displacement of the spring. During these initial rotations, as the user applies work to the system, a rotation-restricting element isolates the ball portioning control and rate limiter. The rotation-restricting element may act as a freewheel, in that the rotational action of two shafts is coupled only in one direction of rotation. By way of non-exhaustive example, a clockwise rotation of the input of the rotation-restricting element will transmit that rotation through to the output of the rotation-restricting element, while a counter-clockwise input rotation would not transmit the rotation through to the output. Similarly, the rotation-restrictive element may transmit counter-clockwise rotation from input to output, while non transmitting clockwise rotations.

Figure 8:
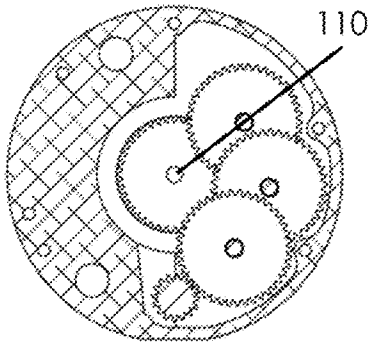
FIG. 8 is a simplified cross-section of an illustrative rate-limiter, where the central shaft is coupled to a compound gear train

The stored energy is then released through subsequent rotation of the ball portioning control as limited or allowed by the rate limiter [104]. The rate limiter may include, but is not limited to, magnetic eddy braking; viscous damping; variable or static friction; momentum; air resistance; and the associated gears, transmissions, and/or conversions to amplify or diminish the effects of one or more of the limiters. In one embodiment of the rate limiter, a sequence of compound gears may increase the rotational speed of a final shaft or component, relative to the rotational speed of the ball portioning control. An illustrative cross-section of such a compound gear train is shown in FIG. 8. This final shaft may be acted upon physically by contact with a solid, liquid, or gas, or electromagnetically to be caused to reach a more stable maximum speed and resist further increases. The stabilized speed would in effect control the rate at which energy is released, the overall speed of the ball portioning control and the rate at which balls are delivered from the device.

Figure 3:
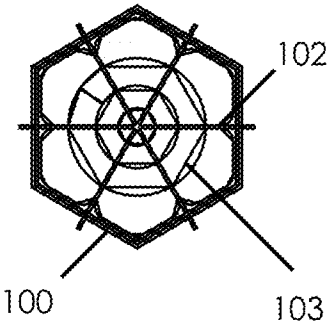
FIG. 3 is a top view of an exemplary embodiment of the present invention in which the ball reservoir is formed through the combination of an outer sleeve and one or more dividers that form multiple cavities within the sleeve

The ball portioning control and ball time control, together or separately, limit the number of balls released by the device as well as the frequency at which balls are released. Referring to FIG. 3, in one embodiment the ball portioning control consists of one or more geometry [103] rotating along an axis parallel, primarily parallel, and/or approximately parallel, to the longitudinal axis of the ball reservoir, said geometry consisting of one or more elements intended to restrict or permit the motion of the balls past the geometry. As the geometry rotates, the restricting and permitting elements directly or indirectly engage with, interact with, encounter, and/or influence the balls within the ball reservoir to permit or restrict the dispensing of said balls. In this embodiment the ball portioning control [103] may, but is not required to, work in conjunction with the elements of the ball reservoir [100, 102] to further restrict the motion of the sports balls.

In a second embodiment the ball portioning control consists of one or more geometry rotating along an axis perpendicular, primarily perpendicular, and/or approximately perpendicular, to the longitudinal axis of the ball reservoir, said geometry consisting of one or more elements intended to restrict or permit the motion of the balls past the geometry. As the geometry rotates, the restricting and permitting elements directly or indirectly engage with, interact with, encounter, and/or influence the balls within the ball reservoir to permit or restrict the dispensing of said balls. In this embodiment the ball portioning control may, but is not required to, work in conjunction with the elements of the ball reservoir to further restrict the motion of the sports balls.

In a third embodiment the ball portioning control consists of one or more geometry rotating along an axis that is neither parallel nor perpendicular to the longitudinal axis of the ball reservoir, said geometry consisting of one or more elements intended to restrict or permit the motion of the balls past the geometry. As the geometry rotates, the restricting and permitting elements directly or indirectly engage with, interact with, encounter, and/or influence the balls within the ball reservoir to permit or restrict the dispensing of said balls. In this embodiment the ball portioning control may, but is not required to, work in conjunction with the elements of the ball reservoir to further restrict the motion of the sports balls.

The ball control element consists of zero or more elements to influences the direction, velocity, and rotation of the ball as it is delivered from the device. Such elements include, but are not limited to, tubes, channels, tracks, platforms, ramps, springs, or baffles to change its trajectory. In the absence of these elements, the ball will likely fall directly as dispensed from the ball portioning control and/or ball time control.

Referring to FIG. 4, in one embodiment the ball reservoir, ball portioning control, ball time control, and ball control element, as well as any and all subsets of these elements, (hereinafter referred to as the "device") are attached to, or otherwise in contact with, a stand, fixture, or other suitable mount (hereinafter referred to as the "stand") [109]. The stand may consist of one or more elements that include, but are not limited to: rigid, collapsible, foldable, telescoping, sliding, locking, and/or interlocking members.

Through this attachment the device may be raised, elevated, or otherwise positioned above the ground. This elevation includes but is not limited to, static elevation wherein the device remains at an approximately fixed elevation during its setup, operation, and takedown, and dynamic elevation wherein the elevation of the device may change during its setup, operation, and takedown. The device may be raised, lowered, pivoted, rotated, translated, or otherwise moved, for a multitude of reasons including, but not limited to: facilitating user experience; facilitating the assembly, loading, unloading, setup, operation, takedown, and/or disassembly of the device; varying the performance of the device; varying the path or trajectory of dispensed sports balls; or in accordance with the user's preference.

The stand may further consist of one or more elements that either contact the ground directly or through one or more intermediary elements. The intermediary elements may be stationary or mobile, and include but are not limited to: carts, baskets, bags, elements of the playing or practice field such as nets, fences, cages, benches, or similar.

The invention claimed is:

1. A system for delivering sports balls to a user comprising:

- a ball reservoir having one or more tubes, channels, pathways or compartments; and
- a ball portioning control that restricts and allows sports balls to exit the ball reservoir; and
- a rate limiting element connected or coupled to the second shaft, wherein the rate limiting element utilizes friction, air resistance, fluid resistance, magnetism, Eddy current braking, resonance, vibration, or any combination therein to influence the time control; and
- a time control that limits or restricts the frequency or interval at which the ball portioning control either restricts or allows sports balls to exit the ball reservoir, wherein said time control comprises:

a first shaft having a first end and a second end; and a spring motor attached to the first shaft; and a freewheel connected or coupled to the second end of the first shaft; and a second shaft having a first end connected or coupled to the freewheel.

2. The system of claim 1, wherein the ball reservoir is comprised of a sleeve and one or more dividers to divide the interior into multiple channels.

3. The system of claim 1, wherein the ball reservoir is collapsible, foldable, expandable, flexible, or otherwise capable of increasing or decreasing its enclosed volume and/or capacity.

4. The system of claim 1, wherein the ball portioning control consists is comprised of a geometry such as a protrusion or inclined plane, revolved helically around a central axis.

5. The system of claim 1, further comprising one or more members to elevate the system above the ground.

6. The system of claim 5, wherein the elevating members are collapsible, foldable, telescoping, or otherwise able to reduce in length.

7. The system of claim 1, wherein the user can rotate the first end of the first shaft with a handle.

* * * * *